US006539647B2

(12) United States Patent
Diaz

(10) Patent No.: US 6,539,647 B2
(45) Date of Patent: Apr. 1, 2003

(54) SAFETY SHOE

(76) Inventor: Frank P. Diaz, 508A Monterey Rd., Pacifica, CA (US) 94044

( * ) Notice: Subject to any disclaimer, the term of this patent is extended or adjusted under 35 U.S.C. 154(b) by 0 days.

(21) Appl. No.: 09/804,976

(22) Filed: Mar. 13, 2001

(65) Prior Publication Data

US 2002/0129517 A1 Sep. 19, 2002

(51) Int. Cl.[7] ..... A43B 13/22

(52) U.S. Cl. ..... 36/72 R; 36/77 R; 36/96; 36/50.1

(58) Field of Search ..... 36/72 R, 77 R, 36/72 A, 72 B, 68, 69, 96, 45, 102, 50.1

(56) References Cited

U.S. PATENT DOCUMENTS

| | | | | | |
|---|---|---|---|---|---|
| 599,341 | A | * | 2/1898 | Meeteer | 36/72 R |
| 1,479,884 | A | * | 1/1924 | Zern | 36/50.1 |
| 22,614 | A | | 3/1945 | Roberts | |
| 2,392,867 | A | | 1/1946 | Stoner et al. | |
| 2,393,810 | A | | 1/1946 | Purinton | |
| 2,555,900 | A | | 6/1951 | Roberts | |
| 2,619,744 | A | * | 12/1952 | Mattes | 36/50.1 |
| 3,102,347 | A | | 9/1963 | Griswold et al. | |
| 4,231,170 | A | | 11/1980 | Griswold | 36/72 |
| 4,656,761 | A | | 4/1987 | Lord | 36/77 |
| 5,152,082 | A | * | 10/1992 | Culpepper | 36/89 |
| 5,566,476 | A | * | 10/1996 | Bertrand et al. | 36/72 R |
| 5,775,007 | A | * | 7/1998 | Expose | 36/72 B |
| 6,151,802 | A | * | 11/2000 | Reynolds | 36/55 |
| 6,298,582 | B1 | * | 10/2001 | Friton et al. | 36/88 |

* cited by examiner

*Primary Examiner*—Mickey Yu
*Assistant Examiner*—Jila M. Mohandesi
(74) *Attorney, Agent, or Firm*—Pearson & Pearson, LLP

(57) ABSTRACT

An improved safety shoe for protecting a person's foot from harmful injury including a high impact resistant outer shell, an inner dense foam insert, a solid toe cap, a heel cup, an inner sole, an outer sole and a moisture dissipating material surrounding the dense foam insert. The outer shell includes a series of flexible interlocking sliding bands arranged surrounding the foot and folding under the foot between the outer sole and the inner sole. Entrance to the boot is by means of a rear opening having a flush mounted buckle for closing the boot around the foot.

26 Claims, 4 Drawing Sheets

SAFETY SHOE

BACKGROUND OF THE INVENTION

1. Field of the Invention

This invention generally relates to safety footwear and in particular to a light weight, flexible, safety shoe having interlocking bands for encasing the metatarsal portion of a foot.

2. Description of Related Art

Persons working in occupations such as warehousing, fire prevention, police protection, transportation and construction often incur foot injuries. Foot injuries are often the worst type of injury and particularly an injury of the metatarsal area. Metatarsal injuries do not heal completely, and ankle injuries on many occasions require fusion in order to alleviate pain. It should be noted that the ankle joint is not replaceable, unlike a shoulder, knee and hip joint.

The most common softer shoe used in industry has been a work shoe having a steel toe cap. This type of shoe has protected the feet of the wearer against certain types of injury and the wearing of such shoes is required in many industries. A very good shoe however, should provide total protection to the toe, metatarsal, heel and ankle of the foot.

In the prior art various approaches have been taken to protect the foot or a portion of the foot from injury. In U.S. Pat. No. 2,555,900 issued Jun. 5, 1951 to S. S. Roberts, a footwear safety guard for a shoe is disclosed comprising a toe cap, a spring fastened underneath the top of the toe cap, a main cover partially mounted on the toe cap having reinforcing ribs, and means for limiting the longitudinal movement of the guard on the footwear which comprises a belt attached to the main cover on each side and attached to a buckle behind the shoe. This approach to protect the feet is somewhat cumbersome.

Another approach to protecting the instep is described in U.S. Pat. No. 4,231,170 issued Nov. 4, 1980 to Frank B. Griswold. A safety shoe instep of compound curvature conforming generally to the shape of the human instep is disclosed. It is constructed as an integral part of the shoe or secured to the toe adjacent at least the lower end of the guard extending upwardly from the region of the toes. The guard includes a plurality of elongated generally arched-shaped rigid strips extending transversely of the instep and are articulated together in overlapping relation to provide an armored protector assembly having sufficient flexibility to permit normal use and movement of the shoe. Although this safety shoe does provide sure protection to the instep, it is a bulky approach to a safety boot.

In U.S. Pat. No. 4,656,761, issued Apr. 14, 1987 to Ronald D. Lord, a footwear reinforcement is disclosed comprising a toe cap portion and rearwardly of the toe cap portion a series of longitudinally-spaced transversely extending curved ribs which extend from one side of the reinforcement to the other. The reinforcement may be made of high impact plastic such as polycarbonated resin. The reinforcement may be embedded in a molded rubber or soft plastic boot during its manufacture by injection molding. However, this reinforcement does not provide total protection to the feet.

SUMMARY OF THE INVENTION

Accordingly, it is therefore an object of this invention to provide a safety shoe to protect against foot injuries and in particular to provide a safety shoe that protects the complete foot and especially the metatarsal area.

It is another object of this invention to provide an improved safety shoe by encircling the foot with flexible plastic interlocking bands.

It is a further object of this invention to provide a shoe with an outer flat sole.

It is another object of this invention to provide a shoe with a dense foam insert to provide a proper fit and comfort to the foot.

The objects are further accomplished by providing a safety boot for protecting a human foot having an inner sole and an outer sole with a toe protector on a front end and a heal protector on a rear end, the improvement comprising shell means for protecting the foot, the shell means having a shape generally conforming to the human foot, comprising interlocking bands extending transversely from the toe protector and upward along a metatarsal area of the foot, an upper portion of the shell means extending beyond the interlocking bands and surrounding an ankle of the foot, dense foam insert means inserted in the shell means for encasing the human foot and providing a snug, comfortable fit, and closure means positioned across a rear opening of the shell means to secure the foot in the boot. The interlocking bands curve downward near the edges of the outer sole and wrap under so as to rest on top of the outer sole. The boot comprises means for allowing dissipation of moisture positioned between the interlocking bands and the dense foam insert means. Each of the interlocking bands of the shell means comprises a curved outer ridge at a first upper end of the bands making approximately a forty-five degree angle with the bands in the direction of the toe protector and an inner ridge positioned on the inner side of the bands approximately two-thirds of the distance from the first upper end of the band and making approximately a forty-five degree angle with the bands in the direction of the heal protector. The outer ridge of the bands interlocks with the inner ridge of the adjacent bands. The shell means comprises a thermoplastic such as a polycarbonated resin for providing strength to the shell means.

The objects are further accomplished by providing a safety boot comprising an outer sole, first protecting means secured to a forward end of the outer sole for protecting toes of a human foot, second protecting means secured to a rear end of the outer sole for protecting a heal of the foot, shell means for protecting the foot, the shell means having a shape generally conforming to a human foot comprising interlocking bands extending transversely from the first protecting means and upward along a metatarsal area of the foot, an upper portion of the shell means extending beyond the interlocking bands and surrounding an ankle of the foot, an inner sole means positioned in the boot resting on a lower portion of the heal protecting means, and a lower portion of the toe protecting means for providing foot comfort, dense foam insert means inserted in the shell means for encasing the human foot and providing a snug, comfortable fit, and means positioned between the bands and the dense foam insert means for allowing dissipation of moisture. The interlocking bands curve downward near the edges of the outer sole and wrap under the inner sole so as to rest on top of the outer sole. Each of the interlocking bands of the shell means comprises a curved outer ridge at a first upper end of the bands making approximately a forty-five degree angle with the bands in the direction of the first protecting means and an inner ridge positioned on the inner side of the bands approximately two-thirds of the distance from the first upper end of the band and making approximately a forty-five degree angle with the bands in the direction of the second protecting means. The outer ridge of the bands interlocks with the inner ridge of the adjacent bands. The upper portion of the shell means comprises a rear opening means extending from the top of the upper portion to approximately midway to a top of the heal protecting means for enabling a foot to enter and exit from the safety boot. The rear opening means comprises means for closing the shell means to secure the foot in the safety boot. The shell means comprises a polycarbonated resin means for providing strength to the shell means.

The objects are further accomplished by a method of providing a safety boot for protecting a human foot comprising the steps of providing an outer sole, protecting toes of a foot with first protecting means secured to a forward end of the outer sole, protecting a heal of the foot with second protecting means secured to a rear end of the outer sole, protecting the foot with shell means having a shape generally conforming to the human foot and comprising interlocking bands extending transversely from the toe protecting means and upward along a metatarsal area of the foot, an upper portion of the shell means extending beyond the interlocking bands and surrounding an ankle of the foot, providing foot comfort with an inner sole means positioned in the boot resting on a lower portion of the heal protecting means and a lower portion of the toe protecting means, encasing the human foot with dense foam insert means inserted in the shell means to provide a snug, comfortable, fit, and dissipating moisture within the safety boot with means positioned between the interlocking bands and the dense foam insert means. The step of protecting the foot with shell means comprises the step of the interlocking bands curving downward near the edges of the outer sole and wrapping under to rest on top of the outer sole. The step of protecting the foot with shell means having interlocking bands comprises the step of providing a curved outer ridge at a first upper end of the interlocking bands making approximately a forty-five degree angle with the interlocking bands in the direction of the first protecting means and providing an inner ridge positioned on an inner side of the interlocking bands approximately two-thirds of the distance from the first upper end of the bands and making approximately a forty-five degree angle with the bands in the direction of the second protecting means. The step of providing the curved outer ridge and the inner ridge of the adjacent bands enables interlocking of the adjacent bands. The method comprises the step of providing a rear opening in the upper portion of the shell means extending from the top of the upper portion to approximately midway to a top of the heal protecting means for enabling the foot to enter and exit from the safety boot. The step of providing a rear opening in the upper portion of the shell means comprises the step of closing the rear opening with means recessed within the upper shell means. The step of protecting the foot with shell means comprises the step of using a polycarbonated resin means for providing strength to protect the foot.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF ILLUSTRATIVE EMBODIMENTS

Figure 1:
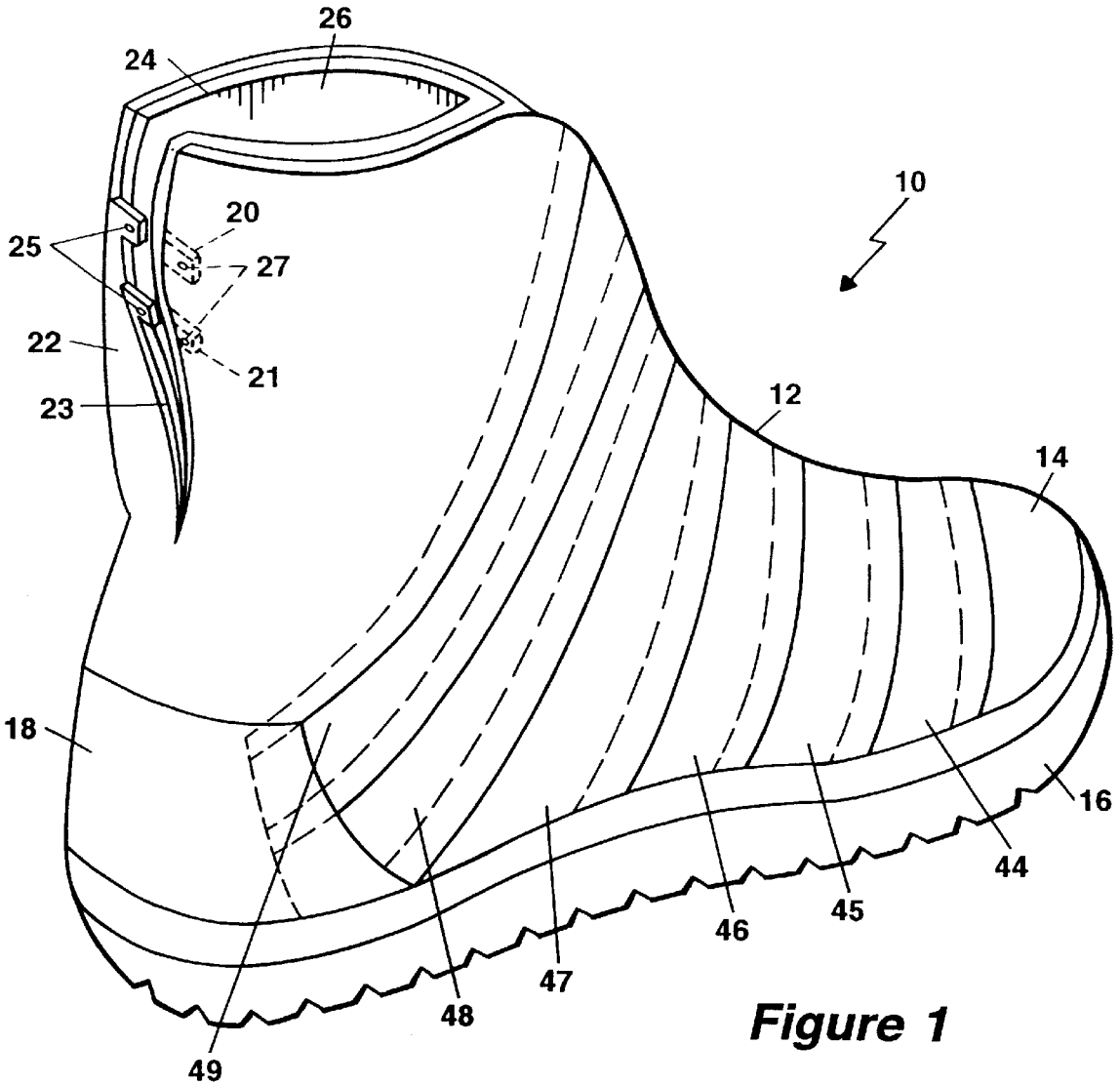
FIG. 1 is a perspective view of a safety shoe showing heal and toe protectors, an outer shell having interlocking bands covering the metatarsal area of a foot, an outer sole and a rear entry with recessed buckles.
Figure 2:
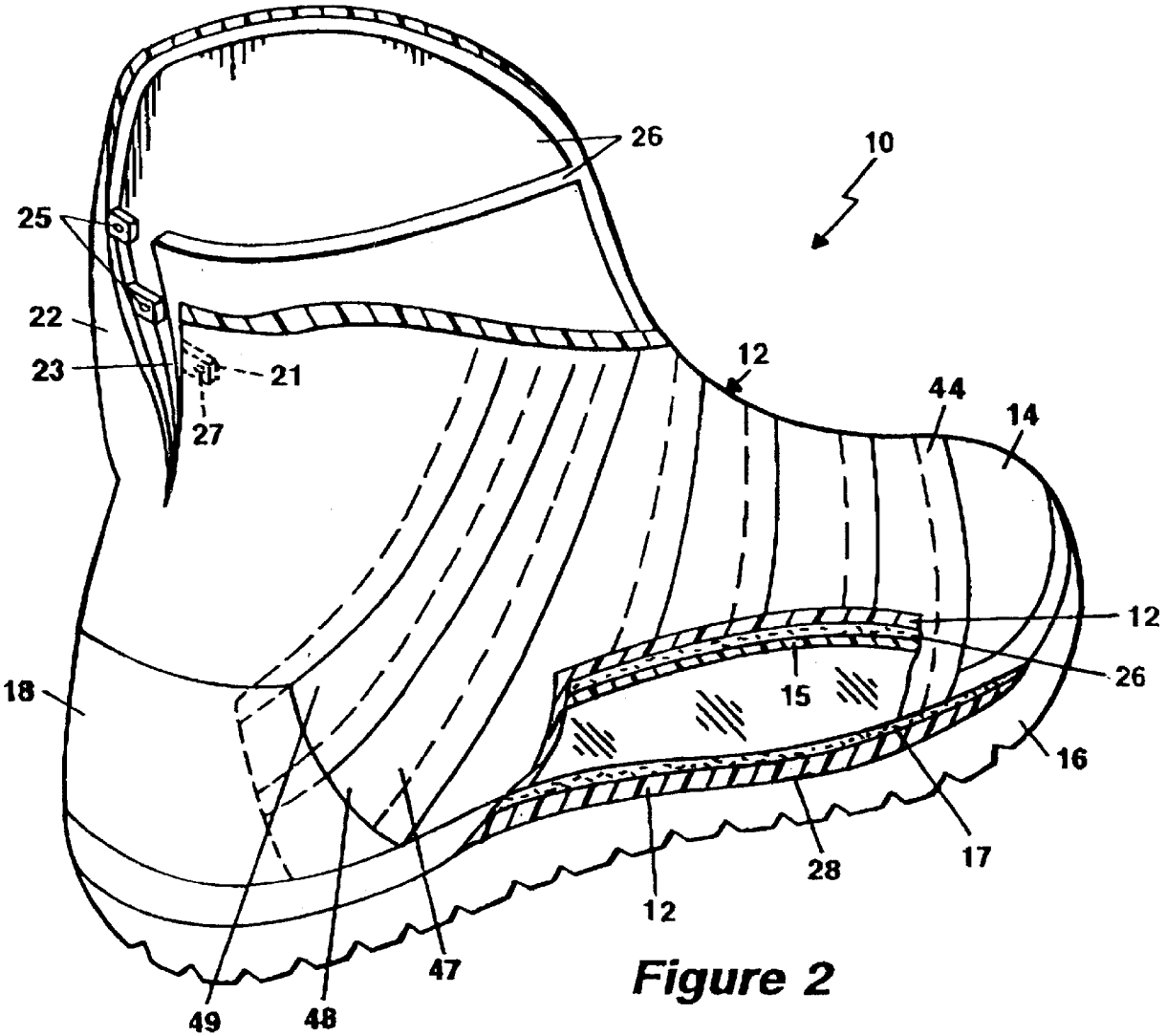
FIG. 2 is a perspective view of the safety boot showing a cutaway near the entry area exposing a dense foam insert and a cutaway on a side of the boot showing the dense foam insert, a layer of moisture dissipating material, an inner sole and the outer shell secured above the outer sole.

Referring to FIG. 1 and FIG. 2, FIG. 1, a perspective view of a high top or work type safety boot embodying the invention which is illustrated and designated generally by the reference number 10. FIG. 2 is a perspective view of the safety boot showing a cutaway near the entry area and a cutaway on a side of the boot exposing elements of the boot 10. The safety boot 10 is intended to provide protection to the toe, metatarsal, heel and ankle of a person's foot. The safety boot 10 includes an outer sole 16, a toe protector 14, a heel protector 18, an innersole 17, an outer shell 12 having circular interlocking bands 44–49 enclosing the metatarsal area or instep and an upper portion 22 of the boot 10 above the ankle, a dense foam insert 26 and a rear entry opening 23 with recessed buckle means 20,21 mounted on the rear upper portion 22 of the shell 12. A material 15 which allows dissipation of moisture is positioned on the inside of the shell 12.

Still referring to FIG. 1 and FIG. 2, FIG. 2 shows a cutaway near the rear entry opening 23 of the upper portion 22 exposing the dense foam insert 26 and also showing a cutaway on a side of the boot exposing the dense foam insert 26, the moisture dissipating material 15, the inner sole 17 and the outer shell 12 shown wrapped under and resting on top 28 of the outer sole 16. The toe of the foot is protected by a one-piece cap made of plastic; the toe cap protector 14 ends at the base of the toes approximately where toes attach to the rest of the foot.

Figure 3:
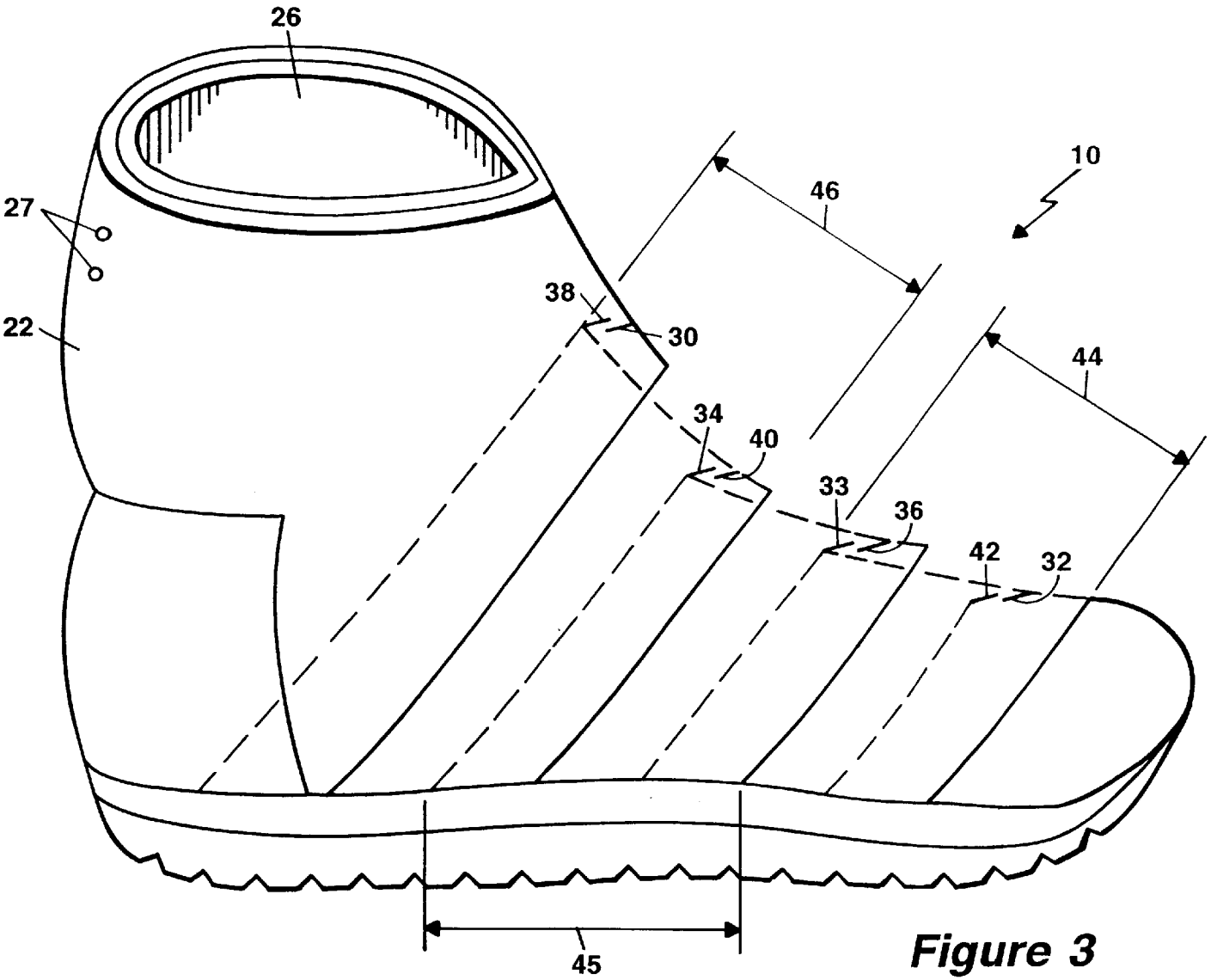
FIG. 3 is an enlarged side view of the safety boot showing overlapping and interlocking bands.
Figure 4:
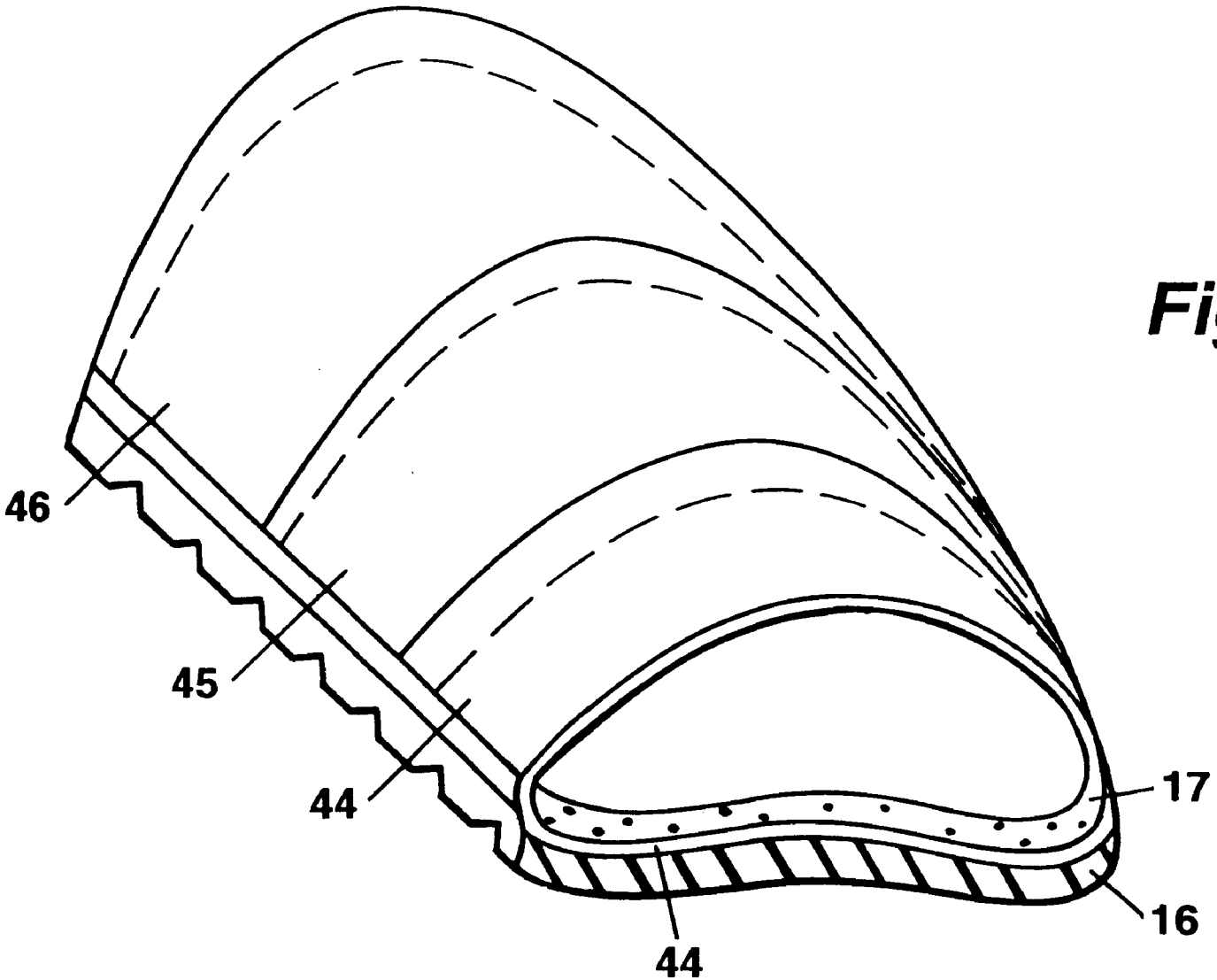
FIG. 4 is a perspective view of the circular interlocking bands of FIG. 3 covering the metatarsal area of the foot.

Referring now to FIG. 1, FIG. 3, and FIG. 4., FIG. 3 shows an enlarged side view of the safety boot 10 and in particular three overlapping and interlocking bands 44, 45, 46 whereas FIG. 1 shows six such bands 44–49. FIG. 4 shows a perspective view of the interlocking bands 44, 45, 46 of FIG. 3 for covering the metatarsal area of the foot. The bands 44, 45, 46 are circular in construction, and they pass between the outer sole 16 and the inner sole 17 in the bottom portion of the safety boot 10 thereby providing complete protection all around the foot of a wearer. The number of bands on the safety boot 10 may be varied depending on the size of a boot and width of the bands over the middle part of the safety boot 10. Typically a band may be approximately one-half to one inch in width and approximately one-eighth or less in thickness. The bands 44, 45, 46 in FIG. 3 are shown being wider and the bands are limited to three in order to clearly illustrate the overlapping and interlocking features.

One of the novel features of the safety boot 10 is the flexibility of the interlocking bands 44, 45, 46 encasing the metatarsal portion of the foot. Two bands 48, 49 as shown in FIG. 1 protect the ankle area and permit flexibility of the ankle area. The bands 48, 49 terminate into the heal cup 18 whereas bands 44–47 as shown in FIG. 1 curve under the foot terminating on top of the outer sole 16. The bands 44, 45, 46 are flush to each other and overlap so as not to allow moisture or dirt in between the bands 44, 45, 46. The bands

44, 45, 46 in FIG. 3 comprise upwardly angled curve edges 33, 34, 38 respectively towards one end of each band, the angle being, approximately 45 degrees relative to the surface of each band 44, 45, 46 which allows one band to slide across the other, but not apart from each other.

Still referring to FIG. 3, the innerside of the bands 44, 45, 46 comprises downwardly angled curved edges 32, 36, 40 respectively positioned approximately two-thirds of the distance between the base of top edges 33, 34, 38 respectively and the bottom edge of each band. The bands 44, 45, 46 have interlocking pairs of edges, for example, edges 32 and 42, edges 36 and 33, edges 40 and 34 and edges 30 and 38. The end of the toe protector 14 includes an upwardly angled curved edge 42 which interlocks with the downwardly angled edge 32 of band 44. Also, the upper shell portion 22 of the safety boot 10 comprises a downwardly angled curved edge 30 for interlocking with upwardly angled curved edge 38 of band 46. The interlocking of the bands 44, 45, 46 allows one band to slide across the other band, but not apart from each other.

Referring again to FIG. 1, the rear entry provides the means for entering the boot similar to a ski boot. However, the buckles 20, 21 are flush with the upper portion 22 of the safety boot 10 instead of being exposed as with a ski boot. The top of the boot 10 ends approximately three or four inches above the ankle joint, thereby allowing the buckles to mold flush within the upper portion 22 of the safety boot 10. The flush mounting of the buckles 20, 21 is necessary to avoid snagging of the buckles on objects which may be found in a warehouse or a construction site, or on objects found when extinguishing a fire. The flush mounting of the buckles 20, 21 also avoids snagging on objects as occurs with lace boots. The buckles may be of various designs known in the art; the buckles 20, 21 shown in FIG. 1 close by the left side of buckle 20, 21 being inserted into the right side of the buckles 20, 21 and snapping closed by means of a sphere top 25 protruding through a hole 27 in the right side. The boot 10 is opened by pressing on the slightly protruding sphere top 25.

The innersole 17 of the safety boot 10 comprises a foot bed where the foot actually rests. The foot bed is approximately one-half inch in height above the bottom of the bands wrapped under the foot and resting on top of the outer sole 16. Therefore, when the foot is inserted into the boot, the foot is fully encircled by the bands 44–49. The inside of the safety boot 10 comprises the dense foam insert 26 in order to allow a snug fit within the safety boot 10. The dense foam insert 26 molds for the accommodation of any variation in foot size.

The outer sole 16 may be a vibram sole which is commonly used on shoes and hiking boots. The vibram sole is glued to the bottom of the bands 44–47, the heal cup 18 and the toe cap 14. This safety boot 10 does not require a standard heal that is utilized in shoes but would have the flat outer sole 16 as shown in the figures similar to a tennis shoe or running shoe to allow for better stability.

The interlocking bands 44–47 and upper shell portion 22 may be embodied by a high impact plastic such as; a polycarbonated resin which is well known in the art. Thermoplastics of differing structural strength may be utilized in the manufacturing of the boot depending on intended applications. The dense foam insert 26 is known in the art and may be embodied by a dense foam as used in ski boots. The moisture dissipating material 15 is well known in the art particularly for use in ski clothes. The heal protector 18 and toe protector 14 may be embodied by solid polycarbonated resin, plastic material being approximately one eighth inch in thickness. The outer sole 16 may be embodied by a vibram sole readily known in the art.

This invention has been disclosed in terms of a certain embodiment. It will be apparent that many modifications can be made to the disclosed embodiment without departing from the invention. Therefore, it is the intent of the appended claims to cover all such variations and modifications as come within the true spirit and scope of this invention.

What is claimed as new and desired to be secured by Letters Patent of the United States is:

1. In a safety boot for protecting a human foot having an inner sole and an outer sole with a toe protector on a front end and a heal protector on a rear end, the improvement comprising:

shell means for protecting said foot, said shell means, having a shape generally conforming to said human foot, comprising interlocking bands extending transversely from said toe protector and upward along a metatarsal area of said foot, an upper portion of said shell means extending beyond said interlocking bands and surrounding an ankle of said foot, and said interlocking bands curve downward near an edge of said outer sole and wrap completely around so as to rest on top of said outer sole;

foam means inserted in said shell means for encasing said human foot and providing a snug, comfortable fit; and closure means positioned across a rear opening of said shell means to secure said foot in said boot.

2. The safety boot as recited in claim 1 wherein said boot comprises means for allowing dissipation of moisture positioned adjacent to said inserted foam means.

3. The safety boot as recited in claim 1 wherein each of said interlocking bands of said shell means comprises a curved outer edges at a first upper end of said bands making approximately a forty-five degree angle with said bands in the direction of said toe protector and an inner edge positioned on an inner side of said bands approximately two-thirds of the distance from said first upper end of said band and making approximately a forty-five degree angle with said bands in the direction of said heal protector.

4. The safety boot as recited in claim 3 wherein said outer edge of said bands interlocks with said inner edge of said adjacent bands.

5. The safety boot as recited in claim 1 wherein said shell means comprises a thermoplastic polycarbonated resin means for providing strength to said shell means.

6. A safety boot comprising:

an outer sole;

first protecting means secured to a forward end of said outer sole for protecting toes of a human foot;

second protecting means secured to a rear end of said outer sole for protecting a heal of said foot;

shell means for protecting said foot, said shell means having a shape generally conforming to a human foot comprising interlocking bands extending transversely from said first protecting means and upward along a metatarsal area of said foot, an upper portion of said shell means extending beyond said interlocking bands and surrounding an ankle of said foot, and said interlocking bands curve downward near an edge of said outer sole and wrap completely around said inner sole so as to rest on top of said outer sole;

an inner sole means positioned in said boot resting on a lower portion of said heal protecting means, and a lower portion of said toe protecting means for providing foot comfort;

foam means inserted in said shell means for encasing said human foot and providing a snug, comfortable, fit; and means positioned adjacent to said foam means for allowing dissipation of moisture.

7. The safety boot as recited in claim 6 wherein each of said interlocking bands of said shell means comprises a curved outer edge at a first upper end of said bands making approximately a forty-five degree angle with said bands in the direction of said first protecting means and an inner edge positioned on an inner side of said bands approximately two-thirds of the distance from said first upper end of said band and making approximately a forty-five degree angle with said bands in the direction of said second protecting means.

8. The safety boot as recited in claim 7 wherein said outer edge of said bands interlock with said inner edge of said adjacent bands.

9. The safety boot as recited in claim 6 wherein said upper portion of said shell means comprises a rear opening means extending from the top of said upper portion to approximately midway to a top of said heal protecting means for enabling a foot to enter and exit from said safety boot.

10. The safety boot as recited in claim 9 wherein said rear opening means comprises means for closing said shell means to secure said foot in said safety boot.

11. The safety boot as recited in claim 6 wherein said shell means comprises a polycarbonated resin means for providing strength to said shell means.

12. The safety boot as recited in claim 6 wherein said first protecting means comprises a plastic toe cap.

13. The safety boot as recited in claim 6 wherein said second protecting means comprises a plastic heal cup.

14. A method of providing a safety boot for protecting a human foot comprising the steps of:

providing an outer sole;

protecting toes of a foot with first protecting means secured to a forward end of said outer sole;

protecting a heal of said foot with second protecting means secured to a rear end of said outer sole;

protecting said foot with shell means having a shape generally conforming to said human foot and comprising interlocking bands extending transversely from the toe protecting means and upward along a metatarsal area of said foot, an upper portion of said shell means extending beyond said interlocking bands and surrounding an ankle of said foot, said interlocking bands curving downward near an edge of said outer sole and wrapping completely around to rest on top of said outer sole;

providing foot comfort with an inner sole means positioned in said boot resting on a lower portion of said heal protecting means and a lower portion of said toe protecting means; and encasing said human foot with foam means inserted in said shell means to provide a snug, comfortable, fit.

15. The method as recited in claim 14 wherein said step of protecting said foot with shell means having interlocking bands comprises the step of providing a curved outer edge at a first upper end of said interlocking bands making approximately a forty-five degree angle with said interlocking bands in the direction of said first protecting means and providing an inner edge positioned on an inner side of said interlocking bands approximately two-thirds of the distance from said first upper end of said bands and making approximately a forty-five degree angle with said bands in the direction of said second protecting means.

16. The method as recited in claim 15 wherein said step of providing said curved outer edge and said inner ridge of said adjacent bands enables interlocking of said adjacent bands.

17. The method as recited in claim 14 wherein said method comprises providing a rear opening in said upper portion of said shell means extending from the top of said upper portion to approximately midway to a top of said heal protecting means for enabling said foot to enter and exit from said safety boot.

18. The method as recited in claim 17 wherein said method comprises the step of closing said rear opening with means molded within said upper shell means.

19. The method as recited in claim 14 wherein said step of protecting said foot with shell means comprises the step of using a polycarbonated resin means for providing strength to protect said foot.

20. The method as recited in claim 14 wherein said method comprises the step of dissipating moisture within said safety boot with means positioned adjacent to said foam means.

21. In a safety boot for protecting a human foot having an inner sole and an outer sole with a toe protector on a front end and a heal protector on a rear end, the improvement comprising:

shell means for protecting said foot, said shell means, having a shape generally conforming to said human foot, comprising interlocking bands extending transversely from said toe protector and upward along a metatarsal area of said foot, an upper portion of said shell means extending beyond said interlocking bands and surrounding an ankle of said foot;

said interlocking bands of said shell means comprises a curved outer edge at a first upper end of said bands making approximately a forty-five degree angle with said bands in the direction of said toe protector and an inner edge positioned on an inner side of said bands approximately two-thirds of the distance from said first upper end of said band and making approximately a forty-five degree angle with said bands in the direction of said heal protector;

foam means inserted in said shell means for encasing said human foot and providing a snug, comfortable fit; and closure means positioned across a rear opening of said shell means to secure said foot in said boot.

22. The safety boot as recited in claim 21 wherein said outer edge of said bands interlocks with said inner edge of said adjacent bands.

23. A safety boot comprising:

an outer sole;

first protecting means secured to a forward end of said outer sole for protecting toes of a human foot;

second protecting means secured to a rear end of said outer sole for protecting a heal of said foot;

shell means for protecting said foot, said shell means having a shape generally conforming to a human foot comprising interlocking bands extending transversely from said first protecting means and upward along a metatarsal area of said foot, an upper portion of said shell means extending beyond said interlocking bands and surrounding an ankle of said foot;

each of said interlocking bands of said shell means comprises a curved outer edge at a first upper end of said bands making approximately a forty-five degree angle with said bands in the direction of said first protecting means and an inner edge positioned on an inner side of said bands approximately two-thirds of the distance from said first upper end of said band and making approximately a forty-five degree angle with said bands in the direction of said second protecting means;

an inner sole means positioned in said boot resting on a lower portion of said heal protecting means, and a lower portion of said to e protecting means for providing foot comfort;

foam means inserted in said shell means for encasing said human foot and providing a snug, comfortable, fit; and means positioned between said bands and said foam means for allowing dissipation of moisture.

24. The safety boot as recited in claim 23 wherein said outer edge of said bands interlock with said inner edge of said adjacent bands.

25. A method of providing a safety boot for protecting a human foot comprising the steps of:

providing an outer sole;

protecting toes of a foot with first protecting means secured to a forward end of said outer sole;

protecting a heal of said foot with second protecting means secured to a rear end of said outer sole;

protecting said foot with shell means having a shape generally conforming to said human foot and comprising interlocking bands extending transversely from the toe protecting means and upward along a metatarsal area of said foot, an upper portion of said shell means extending beyond said interlocking bands and surrounding an ankle of said foot;

providing a curved outer edge at a first upper end of said interlocking bands making approximately a forty-five degree angle with said interlocking bands in the direction of said first protecting means and providing an inner edge positioned on an inner side of said interlocking bands approximately two-thirds of the distance from said first upper end of said bands and making approximately a forty-five degree angle with said bands in the direction of said second protecting means;

providing foot comfort with an inner sole means positioned in said boot resting on a lower portion of said heal protecting means and a lower portion of said toe protecting means;

encasing said human foot with foam means inserted in said shell means to provide a snug, comfortable, fit; and dissipating moisture within said safety boot with means positioned adjacent to said foam means.

26. The method as recited in claim 25 wherein said step of providing said curved outer edge and said inner edge of said adjacent bands enables interlocking of said adjacent bands.

* * * * *